US005790019A

United States Patent [19]

Edwin

[11] Patent Number: 5,790,019

[45] Date of Patent: Aug. 4, 1998

[54] EMERGENCY ALARM SYSTEM

[76] Inventor: Luke Edwin, 14530 Buffalo Spdwy., Houston, Tex. 77045

[21] Appl. No.: 618,467

[22] Filed: Mar. 15, 1996

[51] Int. Cl.[6] ..... G08B 29/00

[52] U.S. Cl. ..... 340/506; 340/514; 340/517; 340/521; 340/541; 340/565; 340/693; 340/286.02; 340/331; 340/332; 340/333; 379/33; 379/39; 379/44; 362/800; 362/812; 345/905

[58] Field of Search ..... 340/506, 507, 340/511, 514, 516, 517, 521, 541, 565, 567, 650, 693, 825.31, 825.32, 825.79, 825.82, 825.81, 286.02, 326, 331, 332, 815.53, 815, 65, 815.66; 379/37, 39, 43, 44, 33; 362/800, 812; 345/905

[56] References Cited

U.S. PATENT DOCUMENTS

| | | | |
|---|---|---|---|
| 3,964,057 | 6/1976 | Wells | 340/304 |
| 4,772,877 | 9/1988 | Rice, Jr. et al. | 340/543 |
| 4,878,236 | 10/1989 | Ray et al. | 379/37 |
| 4,978,946 | 12/1990 | Nordholm et al. | 340/573 |
| 4,993,058 | 2/1991 | McMinn et al. | 379/37 |
| 5,065,136 | 11/1991 | Frolov et al. | 340/545 |
| 5,521,578 | 5/1996 | DelValle | 340/330 |

*Primary Examiner*—Jeffery Hofsass
*Assistant Examiner*—Daryl C. Pope
*Attorney, Agent, or Firm*—Maryam Bani-Jamali

[57] ABSTRACT

This invention provides a new and improved emergency alarm system comprising a central control unit which is directly or indirectly connected to every other component of the emergency alarm system. The central control unit triggers and stops a visual alarm generator and an audio alarm generator, either simultaneously or separately, upon receiving signals from other components of the emergency alarm system. A portable control element and a signal-generating detection means are used for starting and stopping the central control unit, which in turn triggers a power supply means to cause a change, through the visual alarm generator, in color of a visible outdoor board and to commence, through the audio alarm generator, an alarm. A hidden sensing circuit can serve as the signal-generating detection means. The present invention also presents a method of application of said emergency alarm system.

5 Claims, 5 Drawing Sheets

EMERGENCY ALARM SYSTEM

BACKGROUND OF THE INVENTION

1. Field of the Invention

This invention relates to a system for automatically or voluntarily triggering, in case of emergency, a visual alarm generator, comprising a highly visible outdoor board in front of a building, and an audio alarm generator. This invention also describes a method of application of said system.

2. Description of the Prior Art

Any discussion of application of alarms for informing others about an emergency situation arouses several major issues. Alarms for detecting different emergency situations, including but not limited to fires and burglary, at a building, particularly at a residential unit, are usually limited to loud noises and flashing lights inside the building. Use of a combination of loud noises and flashing lights which are detectable outside the building in alarms is rare.

In addition, for an individual who is in need of immediate assistance, more commonly medical attention, and for whom seconds count, usually reaching a telephone to dial an emergency number is difficult or even impossible. For example, for a senior citizen, living alone, who has fallen and broken a bone in the bath tub, dialing an emergency number after reaching the telephone is not a simple task.

Meanwhile, difficulty in identifying a building by an emergency crew can sometimes delay provision of services. Numbering of some residential units are hard to see and find, being small or hidden by different items (e.g. branches of trees), especially at night or during bad weather with heavy showers, snow falls and/or storms. Lack of numbers on residential units is a recurring deterrent for locating residential units.

Various types of alarms have been developed for detecting and informing others of emergency situations as follow:

Wells, U.S. Pat. No. 3,964,057, protects a fire alarm and protection booth having a means for signaling an alarm to a fire station and/or police station, as well as providing a refuge for a person in the case of an emergency. The booth, having an enclosure, is coupled to electrical switches adapted to provide input signals to a solid state control circuit which upon actuation of an alarm switch, sets off an alarm and detains the person in the enclosure for a predetermined period. The solid state control circuit, being tamper-proof, defeats any attempt to compromise the alarm system.

Rice, Jr. et al., U.S. Pat. No. 4,772,877, patents a security indicating attachment for safe-type apparatus. Sensors send signals to a microprocessor which in turn provides audio and/or visual indication to an operator notifying that the apparatus is open or is improperly closed.

Nordholm et al., U.S. Pat. No. 4,978,946, describes a personal security communication system for showing incapacitation of a worker. A first portable unit is used along with a second portable unit in pairs. If one unit of the pair produces status information containing emergency alarm information from the other unit of the pair or fails to receive a message from the other unit within a predetermined time limit, an alarm is produced.

Frolov et al., U.S. Pat. No. 5,065,136, patents an exit door security system using an electromagnet and armature to lock an exit door. An attempt to exit the door causes housing of the electromagnet to pivot and thereby actuate a switch and an alarm to delay any egress through the exit door.

The above listed alarms and many other alarms exist for notifying others of an emergency situation. However, few of these alarms serve simultaneously for detection of fire, burglary and medical emergency. An emergency alarm system is described herein that, in addition to detecting and sending emergency signals for fire, burglary and medical emergency cases, uses a system connected to a highly visible outdoor board being located preferably adjacent to the entrance gate or door of the building and indicating, with flashing lights, the number of the building.

SUMMARY OF THE INVENTION

A primary object of the invention is to provide an improved emergency alarm system that can trigger an audio alarm generator and a visual alarm generator during fires, burglaries and medical emergency situations.

Another object of this invention is to devise a new and improved emergency alarm system that is easily accessible by its owner.

An additional object of this invention is to design a new and improved emergency alarm system that has a microelectronic design and is tamper-proof.

Another object of this invention is to provide a new and improved emergency alarm system that can be started manually and by sensors.

An additional object of this invention is to devise a means to automatically inform an emergency crew of the occurrence of an emergency condition.

A final object of this invention is to devise an improved emergency alarm system that provides a highly visible address identification.

Additional objects and advantages of the invention will be set forth in part in a detailed description which follows, and in part will be obvious from the description, or may be learned by practice of the invention.

In general, the present invention has been developed against the above background, to provide application of a new and improved emergency alarm system for buildings and for individuals. The emergency alarm system is a means for signaling, in case of emergency, an alarm, from a central control unit. The described emergency alarm system detects and sends signals in case of fire, burglary and medical emergency. The alarm system may be programmed to, in case of emergencies, contact a corresponding assisting service and trigger an audio alarm generator and a visual alarm generator. In addition, the emergency alarm system includes a highly visible outdoor board that is preferably located adjacent to an entrance gate or door of the building and indicates, with flashing lights, the number of the building in order to facilitate detection of the building by an emergency crew. The highly visible outdoor board comprises light emitting diodes (LED) or light crystal diodes (LCD) of dual color: red and green. When the building is in normal conditions, green LED or green LCD are activated to present numbering of the building on the visible outdoor board in green. When the building is in emergency conditions, red LED or red LCD are activated to present numbering of the building on the visible outdoor board in red. Use of said LED or LCD facilitates spotting of the building in emergency conditions by the emergency crew when the LED or LCD are in red. If desired, switching of green LED to red LED or of green LCD to red LCD can also automatically trigger the audio alarm generator.

The emergency alarm system may be supplemented by other features, including but not limited to door bells, television transmitters, voice units for communicating with an entering party, optional porch lights and optional cameras.

Also, this invention relates to providing a method of operation of said emergency alarm system. Under normal conditions, the LED or the LCD of the highly visible board are green. Upon ringing of the doorbell, the resident can use the television transmitter which is connected to cameras located adjacent to the highly visible board to identify the entering party. If desired, an optional porch light can be turned on by the resident. A voice unit exists for enabling the resident to communicate with the entering party. The resident can open the gate or the door for the entering party when no danger is felt. The resident can turn on the alarm generator, whether visual alarm generator or audio alarm generator or both, at this point or any other time if the resident senses a threat of burglary, fire or medical emergency. A portable control element with a manually-operated control button or switch may be used by the resident to trigger the visual alarm generator and/or the audio alarm generator.

If an intruder enters the property without the resident being notified, the visual alarm generator and/or the audio alarm generator may be triggered without knowledge of the resident. A hidden series of connected sensors may be used in the building adjacent to any entrance into the building. Upon stepping on any hidden sensor, the visual alarm generator and/or the audio alarm generator will be triggered automatically.

It is to be understood that the descriptions of this invention are exemplary and explanatory, but are not restrictive, of the invention. Other objects and advantages of this invention will become apparent from the following specification and from any accompanying charts, tables, examples and drawings.

BRIEF DESCRIPTION OF CHARTS, TABLES, EXAMPLES AND DRAWINGS

Any accompanying charts, tables, examples and drawings which are incorporated in and constitute a part of this specification, illustrate examples of preferred embodiments of the invention and, along with the description, serve to explain the principles of the invention.

DETAILED DESCRIPTION OF THE PREFERRED EMBODIMENT

Preferred embodiments of the present invention are illustrated in any charts, tables, examples and drawings that follow.

Figure 1:
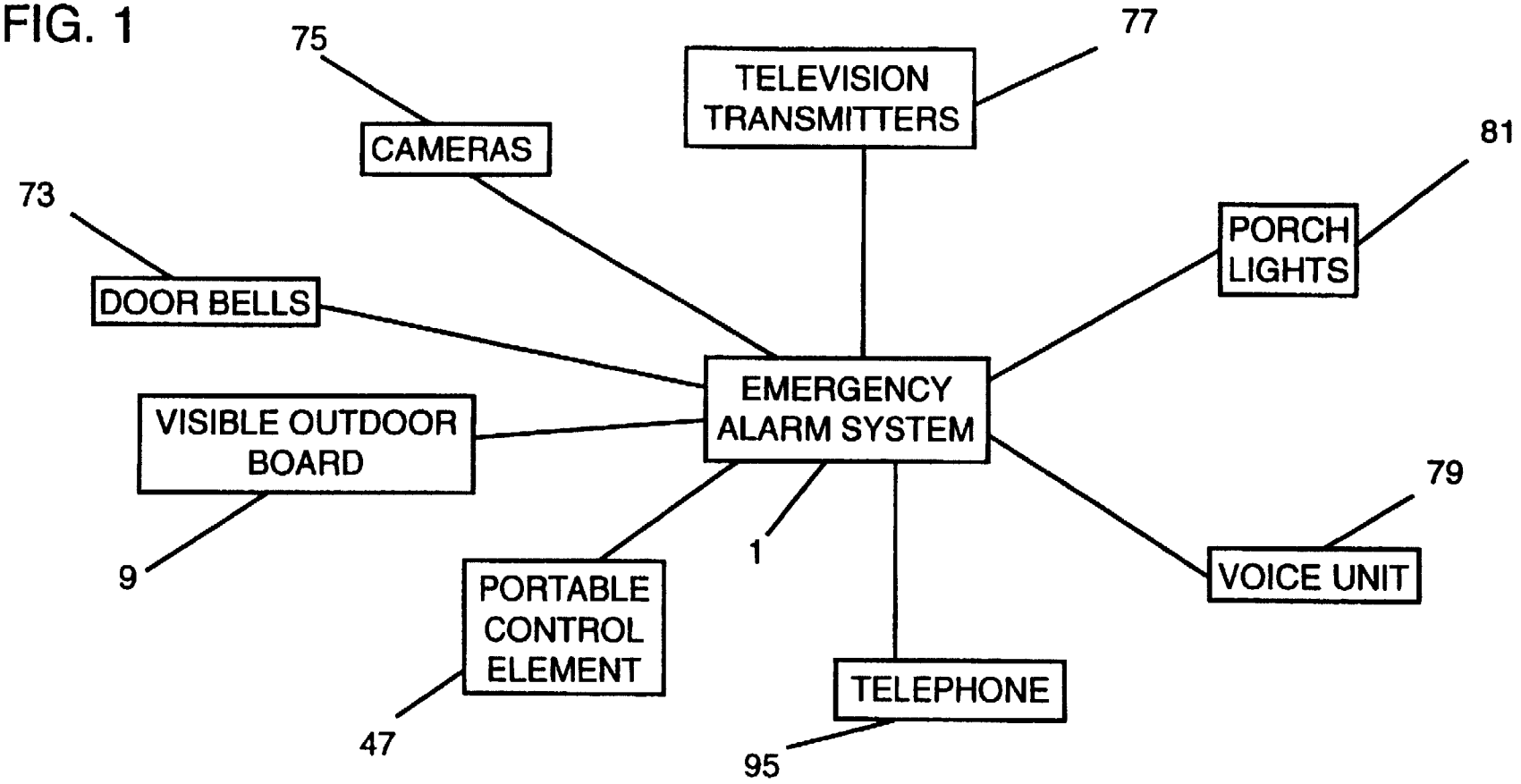
FIG. 1 is a block diagram of an emergency alarm system indicating some components of the emergency alarm system with which a user is normally in direct contact.

The present invention provides a new and improved emergency alarm system 1 (as shown in FIG. 1). In addition the present invention demonstrates a method of application of said emergency alarm system 1.

Figure 3:
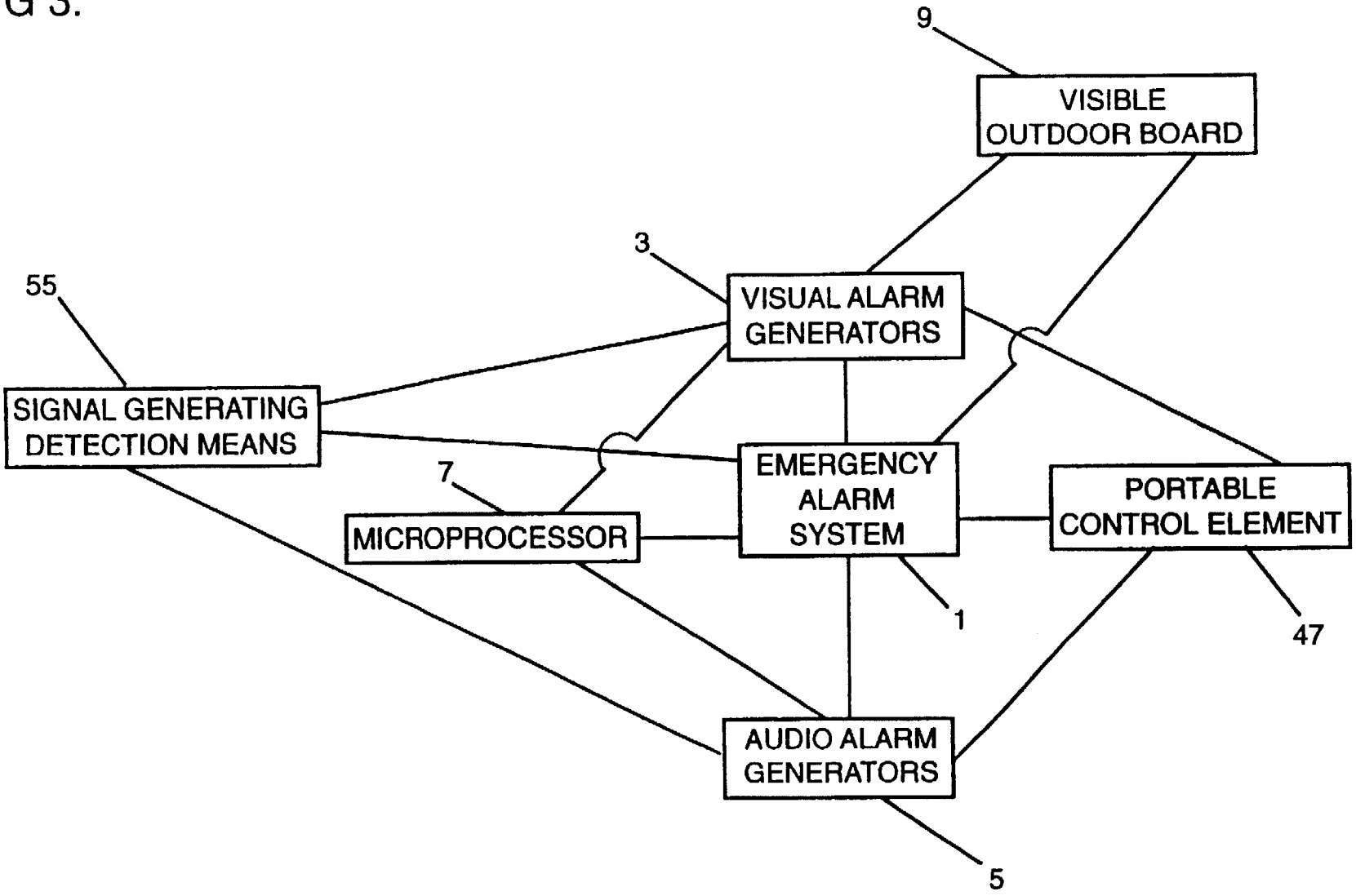
FIG. 3 is a block diagram of the emergency alarm system of FIG. 1, with major components of the emergency alarm system being indicated.
Figure 5:
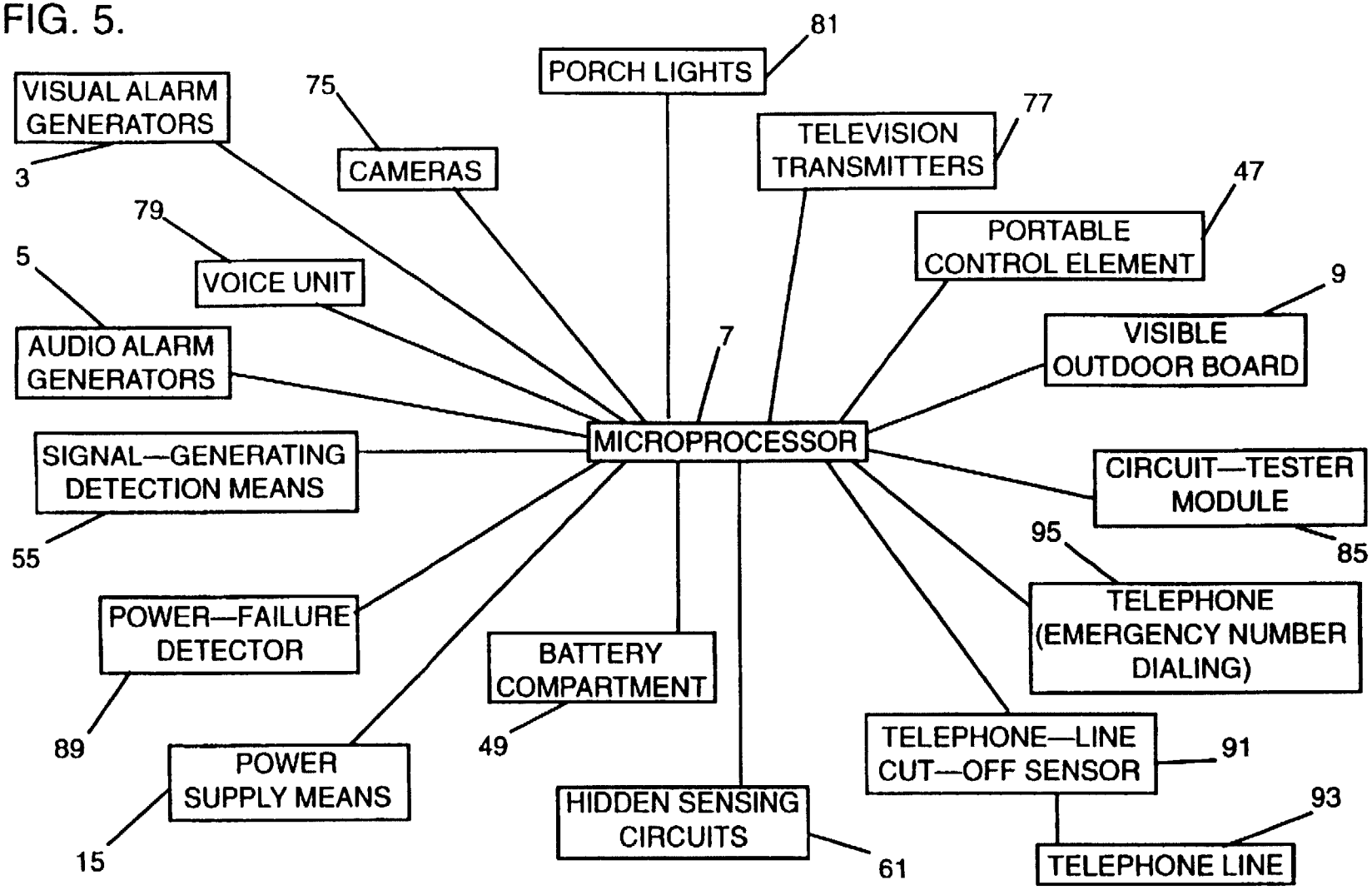
FIG. 5 is a block diagram of a microprocessor of the emergency alarm system as shown in FIG. 3, with some components of the emergency alarm system that are directly or indirectly connected to the microprocessor being indicated.

This new and improved emergency alarm system 1 may be used in buildings, particularly in residential units. The emergency alarm system 1 is a means for voluntarily or automatically triggering, in case of emergency, a visual alarm generator 3 and/or an audio alarm generator 5, from a central control unit 7 (referred to hereinafter as "microprocessor"). (Please refer to FIG. 3 and FIG. 5.) The alarm system generator 5 may be programmed to, in case of fire, burglary, and medical emergencies and other emergency situations (referred to hereinafter as "emergency situation"), contact a corresponding assisting service. For example, a fire signal would contact a proximate fire station, a signal of burglary would notify a police station within a neighboring area, and a medical emergency signal would inform a relatively close hospital. In addition, the emergency alarm system 1 includes a highly visible outdoor board 9 that is preferably located adjacent to entrance of the building and indicates, with flashing lights, the number of the building in order to facilitate detection of the building by an emergency crew.

Figure 2:
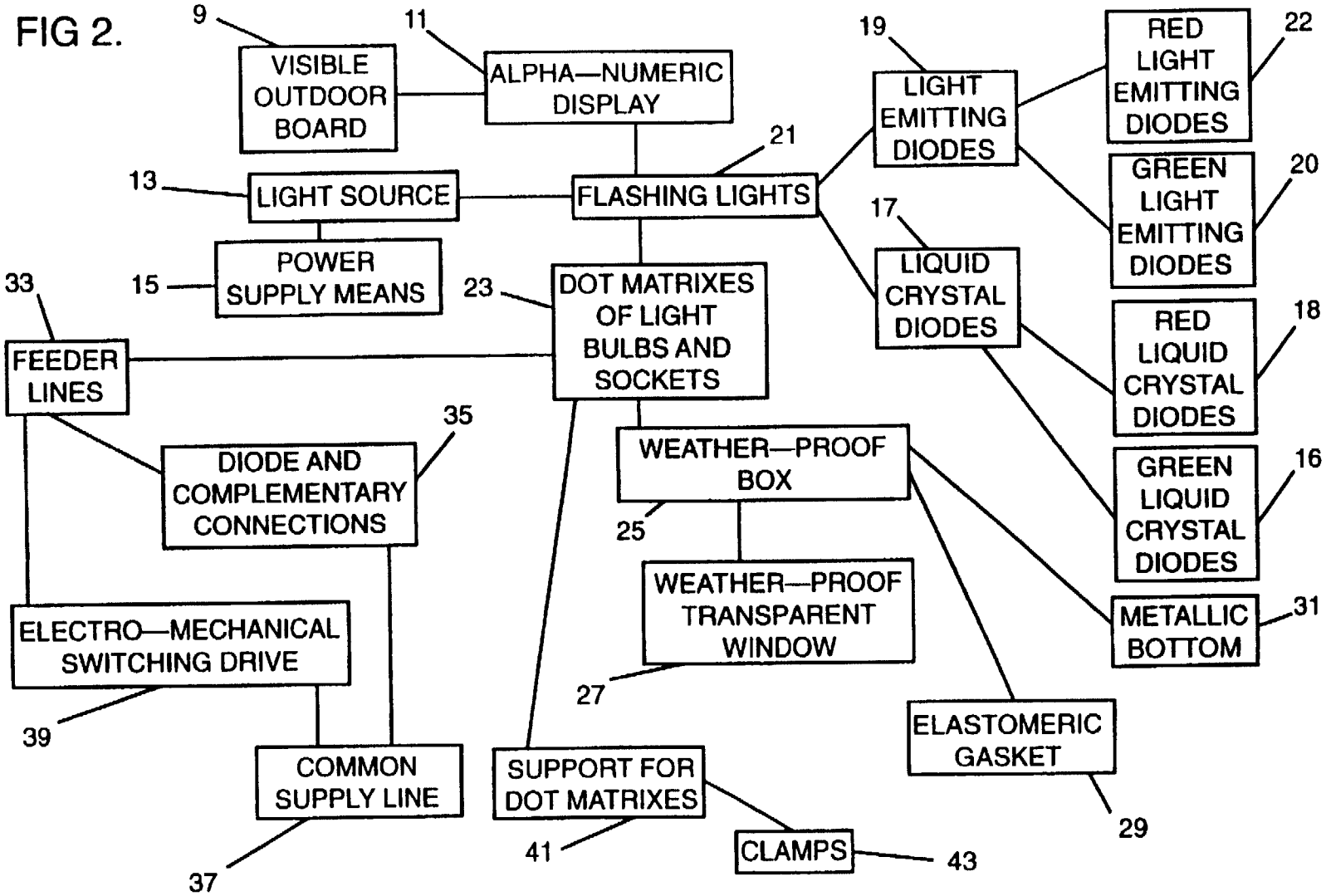
FIG. 2 is a block diagram of a visible outdoor board of the emergency alarm system of FIG. 1, with some components of the emergency alarm system that are associated with the visible outdoor board being indicated.

The new and improved emergency alarm system 1 is connected to the visible outdoor board 9 comprising an alpha-numeric display 11, arranged with lights of any color, to clearly and brightly identify the building. (Please refer to FIG. 2.) The alpha-numeric display 11 is normally installed at highly visible parts either on or adjacent to the building and facing the street. An additional alpha-numeric display 11 may be installed inside and in a visible part of the building in order to back up the original alpha-numeric display 11. A light source 13 of relatively high wattage, supplied by a power supply means 15, is used to provide sufficient light on the visible outdoor board 9 in order to assist an emergency crew to locate the building quickly and easily. Liquid crystal diodes (LCD) 17 or light emitting diodes (LED) 19 can be used as flashing lights 21. Also, dot matrixes of light bulbs and sockets 23 can be used in the alpha-numeric display 11. Said dot matrixes of light bulbs and sockets 23 are housed in a weather-proof box 25, are sealed on the face of the alpha-numeric display 11 with a weather-proof transparent window 27 and are sealed to the weather-proof box 25 with an elastomeric gasket 29. The dot matrixes of light bulbs and sockets 23 are mounted on a support for dot matrixes 41, held in position with clamps 43. The weather-proof box 25 is combined with a metallic bottom 31, creating an individual space for any electrical wiring. The metallic bottom 31 and the electrical wiring are fastened onto front face of the weather-proof box 25. All light bulbs of the dot matrixes of light bulbs and sockets 23 are connected from feeder lines 33 through diode and complementary connections 35, to a common supply line 37. An electro-mechanical switching drive 39 can also be used to energize the common lines 37 and the feeder lines 33. The highly visible outdoor board 9 usually comprises LED 19 or LCD 17 of dual color (preferably red and green), with non-emergency conditions in the building being indicated by one color and emergency conditions in the building being indicated by a different color. When the building or resident of the building is in normal conditions, the green LED 20 or the green LCD 16 are activated to present numbering of the building or family name of residents or both, as well as any other desired information, on the visible outdoor board 9 in green. When the building or resident is in emergency conditions, the red LCD 18 or the red LED 22 are activated to present numbering of the building, as well as any other desired information, on the visible outdoor board 9 in red. The green LCD 16 or the green LED 20 are replaced immediately by the red LCD 18 or the red LED 22, respectively. Use of said LCD 17 or LED 19 facilitates spotting of the building in emergency conditions by the emergency crew when the LCD 17 or LED 19 are in red. There have been cases when the emergency crew has failed to provide sufficient assistance due to difficulty in locating the building. In addition, the green LCD 16 or the green LED 20, being clear and bright, assist in more easily and more rapidly identifying the building in normal conditions. In addition, the highly visible outdoor board 9 can serve as an annunciator of pre-programmed messages.

Besides distinguishing emergency and normal conditions by different colors of LCD 17 or LED 19, the audio alarm generator 5 may be used in the emergency alarm system 1 to indicate cases of emergency. If desired, change of green LCD 16 or green LED 20 to red LCD 18 or red LED 22, respectively, upon commencement of an emergency condition can automatically trigger the audio alarm generator 5. The audio alarm generator 5 can also be started manually by the resident when the resident starts the emergency alarm system 1 by turning on a manually-operated control button or switch 45 of a portable control element 47 serving as a distant control element that is carried by or somehow attached to the resident of the emergency alarm system 1. A necklace, a bracelet, a pin or any other portable item can be used as the portable control element 47 which may be used to dial a number, such as an emergency number, on a telephone 95. The manually-operated control button or switch 45 controls the circuit, which on actuation of the manually-operated control button or switch 45, triggers the audio alarm generator 5 and/or the visual alarm generator 3. The generated alarm continues until it is stopped by an individual or upon being disconnected from a power supply means 15 and running out of batteries located in a battery compartment 49. The visual alarm and the audio alarm can be stopped by the resident upon turning off the visual alarm generator 3 and the audio alarm generator 5 by touching a reset switch 51 located somewhere in the building, thus resetting the visual alarm generator 3 and the audio alarm generator 5 to non-emergency conditions (i.e. green LCD 16 or green LED 20 being turned on). To avoid tampering of the reset switch 51, the reset switch 51 is preferably hidden in the building. The emergency alarm system 1 can be designed to notify the resident upon any tampering of the emergency alarm system 1.

A battery voltage indicator 53 can be provided to sense when voltage of batteries falls below a predetermined threshold and to give a warning display, for example by flashing a light attached to the battery compartment 49. The battery compartment 49 is connected to electronic circuitry of the emergency alarm system 1. The battery compartment 49 is designed in order to allow convenient change of batteries by the resident. When the emergency alarm system 1 is deactivated upon termination of the emergency condition, the emergency alarm system 1 is in a quiescent or stand-by state. However, the power supply means 15 and/or the batteries are operable to provide the necessary power supply potentials.

A signal-generating detection means 55 may be used to indicate entry of an intruder through an entrance into the building. The signal-generating detection means 55 is generally made up of a signal generating means 57 (e.g. a pair of infrared light emitting diodes or a pair of infrared liquid crystal diodes) and a signal detection means 59 (e.g. photosensitive transistors or semiconductors). The signal generating means 57 is connected to the power supply means 15 and is operatively associated with the signal detection means 59. (Please refer to FIG. 4.) As soon as any signal-generating detection means 55 is activated, the power supply means 15 causes a change in color of the LED 19 or the LCD 17, from green to red.

Figure 4:
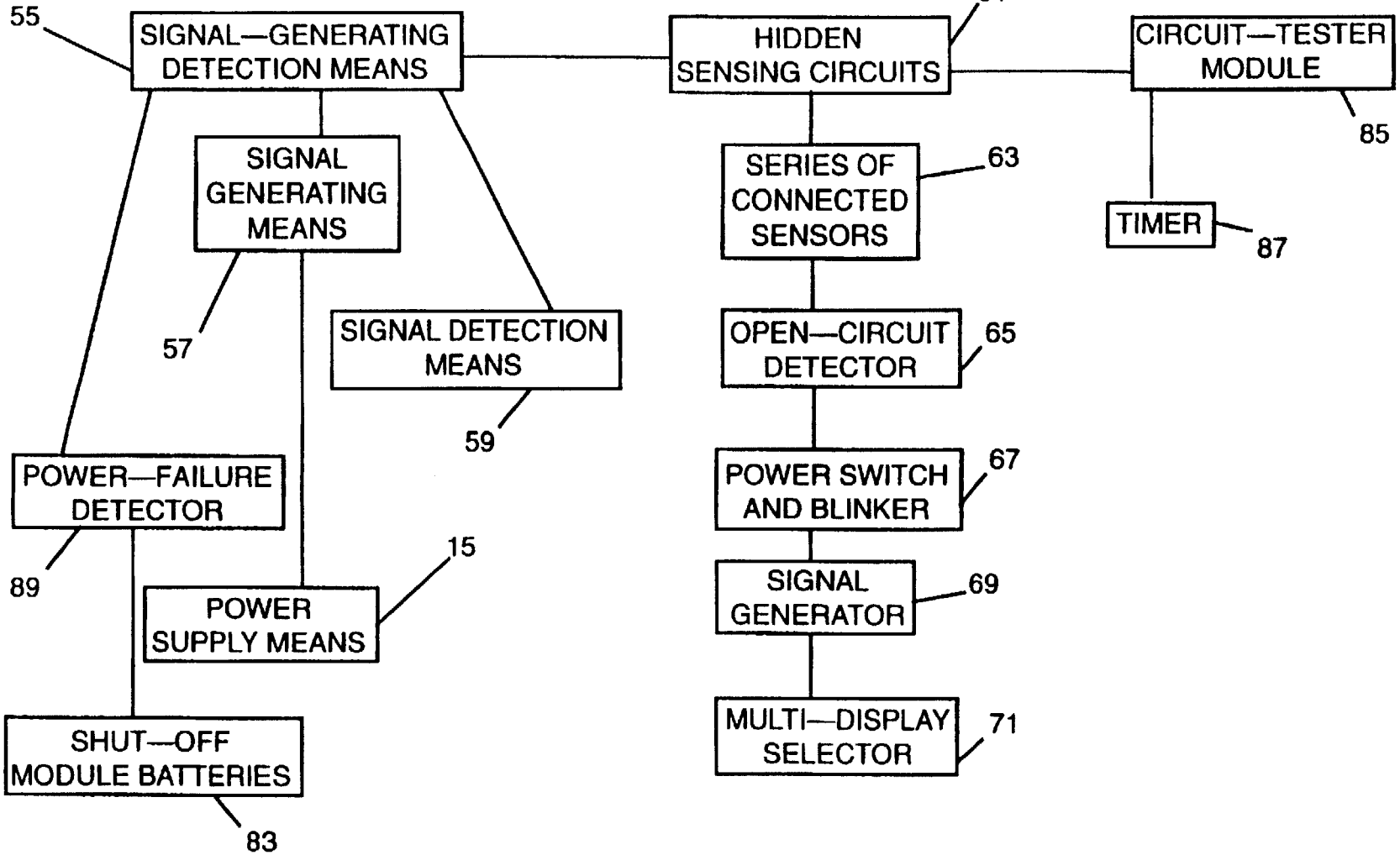
FIG. 4 is a block diagram of a signal-generating detection means of the emergency alarm system as shown in FIG. 3, with some components of the emergency alarm system that are associated with the signal-generating detection means being indicated.

In addition, as shown in FIG. 4, a hidden sensing circuit 61 may be used. The hidden sensing circuit 61 comprises a series of connected sensors 63, connected to one another in a closed loop, adapted to sense movement upon stepping on a covering placed over an open-circuit detector 65 located on a floor immediately following an entrance into the building or adjacent to any openings through which a stranger may enter into the building, including but not limited to windows, garage doors, chimneys, kitchen doors and doors opening to yards. When any series of connected sensors 63 is interrupted, the open-circuit detector 65 is activated. The open-circuit detector 65 in turn activates the power switch and blinker 67 to feed the signal generator 69 which generates a triggering signal. A multi-display selector 71 forwards the generated signal to the visual alarm generator 3 and/or to the audio alarm generator 5.

The emergency alarm system 1 may be supplemented by other devices, including but not limited to door bells 73, cameras 75, television transmitters 77, voice units 79 and porch lights 81. Many of these supplementary devices are used for communicating with an entering party and for controlling the visual alarm generator 3 and/or the audio alarm generator 5. These features are added to complement the connection of the resident with the entering party and/or to increase the control of the resident over any emergency condition. The above components of the emergency alarm system 1, as well as other supplementary devices, are directly or indirectly connected to the microprocessor 7 which serves as the central organizer, controller and actuator of the emergency alarm system 1. (Please refer to FIG. 5.)

As a component of the emergency alarm system 1, the microprocessor 7 is used to turn on and to stop the audio alarm generator 5 and the visual alarm generator 3. The microprocessor 7, upon receiving signals from signal-generating detection means 55, or from the manually operated control button 45, triggers the audio alarm generator 5 and the visual alarm generator 3. The microprocessor 7, along with other parts of the emergency alarm system 1, is energized either by the power supply means 15 or by batteries of the battery compartment 49. Shut-off module batteries 83 are used to make the emergency alarm system 1 immune from temporary interruption of power supply, whether intentional or accidental. A shut-off module, used with the power supply means 15, verifies functionality of the shut-off module batteries 83 in case of emergency. On the other hand, a power failure causes a power-failure detector 89 to automatically start the shut-off module batteries 83. A circuit-tester module 85 allows the resident to energize the highly visible outdoor board 9 and the audio alarm generator 5, but only for a short period of time. A timer 87 then switches the hidden sensing circuits 61 back to a "green" condition, ready to be triggered by any emergency situation.

A telephone-line cut-off sensor 91 can be set up at entry of the telephone line 93 into the building. A disconnection or cutting-off of the telephone line 93 can be transmitted to the microprocessor 7 which automatically turns on the red LED 22 or the red LCD 18. The microprocessor 7 can be programmed to recognize emergency numbers, such as 911 and telephone numbers of fire department, police department and hospitals, and to activate the red LED 22 or the red LCD 18 upon detection of emergency numbers.

Also, this invention relates to providing a method of operation of said emergency alarm system 1. Energy is provided to components of the emergency alarm system 1 by using the power supply means 15 that is made immune from temporary interruption of power supply by using the power-failure detector 89 which automatically triggers shut-off module batteries 83. Any desired alpha-numeric display 11 is demonstrated in any desired color on the visible outdoor board 9. Under normal conditions, the LED 19 or the LCD 17 of the highly visible outdoor board 9 are green. Upon ringing of the door bell 73, the resident can use the television transmitters 77 which are connected to the cameras 75 located adjacent to the highly visible outdoor board 9 to identify the entering party. If desired, optional porch lights 81 can be turned on by the resident. A voice unit 79 exists for enabling the resident to communicate with the entering party. The resident can open the gate or the door for the entering party when no danger is felt. The resident can turn on the audio alarm generator 5 and/or the visual alarm generator 3 at this point or any other time if the resident senses a threat of burglary, fire or medical emergency, thus changing the color of the alpha-numeric display 11. In cases of emergency, the central control unit 7 is triggered by turning on the manually-operated control button or switch 45 of the portable control element 47 or by activating the signal-generating detection means 55. The signal-generating detection means 55 is activated by automatic sensing of movement by the hidden sensing circuit 61. The hidden sensing circuit 61 may be activated by the open-circuit detector 65 when continuity of the electrical circuit of the series of sensing circuits 63 is interrupted. Upon generation of a signal, the multi-display selector 71 triggers any selected alarm. Activation of the central control unit 7 declares an emergency situation by triggering solely the visual alarm generator 3, solely the audio alarm generator 5, the audio alarm generator 5 and the visual alarm generator 5 simultaneously, solely the visual alarm generator 3 which results in tuning on of the audio alarm generator 5, or solely the audio alarm generator 5 which results in turning on of the visual alarm generator 3. By using information saved in the central control unit 7, the user of the emergency alarm system 1, personally or automatically, informs and gets assistance form a third party if desired. Upon termination of the emergency situation, the audio alarm and the visual alarm are stopped through use of the central control unit 7 by turning on the reset switch 51 or turning off, when desired, the manually-operated control button or switch 45 of the portable control element 47.

If an intruder enters the property without the resident being notified, the visual alarm generator 3 and/or the audio alarm generator 5 may be triggered without knowledge of the resident. The hidden series of connected sensors 63 may be used in the building adjacent to any entrance into the building. The alarm will originate from an interruption of the series of connected sensors 63 when the continuity of an electrical circuit is interrupted. Upon stepping on the hidden series of connected sensors 63, the visual alarm generator 3 and/or the audio alarm generator 5 will be triggered automatically. The interruption of the electrical circuit can also be triggered by a number of factors, including but not limited to voluntary interruption by the resident, entry of a burglar or of any other intruder detected by the signal detection means 59 (e.g. ultrasound, infrared and ultraviolet motion detectors), detection of high levels of unwanted gases such as carbon dioxide and carbon monoxide, detection of a temperature higher than a set limit, triggering of a smoke detector, dialing of emergency numbers (e.g. 911), disconnection of the telephone wires or of electrical utility lines, sudden loud noise sensors activated by gun shots, yelling, breaking of a window glass or explosion, remote radio signals by the resident or by the surveillance cameras 75, and activation of secret switches by the resident.

Upon activation of the emergency alarm system 1, an audio alarm or a visual alarm is started. The LED 19 or the LCD 17 of the highly visible outdoor board 9 switch from green to red automatically. Preferably, the red LED 22 or red LCD 18 will be flashing in order to attract more attention. The audio and visual alarms continue to indicate an emergency condition until the visual alarm generator 3 and/or the audio alarm generator 5 are turned off.

Certain objects are set forth above and made apparent from the foregoing description, drawings and examples. However, since certain changes may be made in the above description, drawings and examples without departing from the scope of the invention, it is intended that all matters contained in the foregoing description, drawings and examples shall be interpreted as illustrative only of the principles of the invention and not in a limiting sense. With respect to the above description and examples then, it is to be realized that any descriptions, drawings and examples deemed readily apparent and obvious to one skilled in the art and all equivalent relationships to those stated in the examples and described in the specification or illustrated in the drawings are intended to be encompassed by the present invention.

Further, since numerous modifications and changes will readily occur to those skilled in the art, it is not desired to limit the invention to the exact construction and operation shown and described, and accordingly, all suitable modifications and equivalents may be resorted to, falling within the scope of the invention. It is also to be understood that the following claims are intended to cover all of the generic and specific features of the invention herein described, and all statements of the scope of the invention which, as a matter of language, might be said to fall therebetween.

What is claimed as invention is:

1. A new and improved emergency alarm system for a building comprising following components:

(a) a visual alarm generator for triggering visual alarms;

(b) an audio alarm generator for triggering audio alarms;

(c) a central control unit to which any other component of the emergency alarm system is directly or indirectly connected, with a major function of said central control unit being triggering and stopping the visual alarm generator and triggering and stopping the audio alarm generator, either simultaneously or separately, upon receiving signals from the other components of the emergency alarm system;

(d) a visible outdoor board being located adjacent to entrance of the building and displaying any desired information in any desired color, with non-emergency conditions in the building being indicated by one color and emergency conditions in the building being indicated by a different color;

(e) a power supply means for providing energy to the components of the emergency alarm system;

(f) a circuit-tester module allowing energization of the visual alarm generator and of the audio alarm generator for a limited period of time;

(g) a portable control element having a manually-operated control button or switch for triggering or stopping the central control unit when desired;

(h) a reset switch for stopping an alarm generated by the visual alarm generator and by the audio alarm generator;

(i) a signal-generating detection means which, upon activation, triggers the power supply means to cause a change in color of the visible outdoor board and triggers the audio alarm generator, said signal-generating detection means comprising:

i. a signal generating means being connected to the power supply means, ii. a signal detection means being operatively associated with the signal generating means and, upon detection of an emergency condition, activating the signal generating means and, as a result, the signal-generating detection means, iii. a power-failure detector for automatically starting existing shut-off module batteries which are used to make the emergency alarm system immune from temporary interruption, whether intentional or accidental, of power supply to the power supply means, and iv. a hidden sensing circuit comprising:

A. a series of connected sensors connected to one another in a closed loop,

B. an open-circuit detector placed under a covering and connected to the series of connected sensors, C. a power switch and blinker activated by the open-circuit detector, D. a signal generator activated by the power switch and blinker to generate a signal, and E. a multi-display selector which forwards the generated signal to trigger any selected alarms; and (j) supplementary devices, including, but not limited to, door bells, cameras, television transmitters, voice units and porch lights, said supplementary devices used for identifying and communicating with an entering party; such that said components of the emergency alarm system are connected either directly or indirectly to one another to more clearly identify the building, to minimize possibilities of tampering of the emergency alarm system, to activate, during any emergency situation, the visual alarm generator and the audio alarm generator and to form any desired third parties of the emergency situation.

2. The emergency alarm system according to claim 1, wherein the visible outdoor board comprises:

(a) an alpha-numeric display on front side of the visible outdoor board;

(b) flashing lights, positioned inside the visible outdoor board, for clearly indicating any information desired by owner of the building on face of the alpha-numeric display, said flashing lights using either liquid crystal diodes or light emitting diodes, with the liquid crystal diodes, as well as the light emitting diodes, having individually-applied and separately-used colors including red and green, with the green color illuminating the visible outdoor board during non-emergency conditions and with the red color illuminating the visible outdoor board during emergency conditions;

(c) dot matrixes of light bulbs and sockets, said light bulbs being connected from feeder lines through diode and complementary connections to a common supply line, with an electro-mechanical switching drive being used to energize the common lines and the feeder lines;

(d) a weather-proof box for housing said dot matrixes of light bulbs and sockets and having a metallic bottom, said metallic bottom creating space for any electrical wiring;

(e) weather-proof transparent window sealing the dot matrixes of light bulbs and sockets on the face of the alpha-numeric display;

(f) an elastomeric gasket sealing the dot matrixes of light bulbs and sockets to the weather-proof box;

(g) a support for the dot matrixes of light bulbs and sockets; and (h) clamps for holding the dot matrixes of light bulbs and sockets in position on the support.

3. The emergency alarm system according to claim 1, wherein a telephone-line cut-off sensor is set up at entry of any telephone lines into the building such that upon disconnection of the telephone line, the microprocessor automatically triggers an alarm.

4. A method of operation of a new and improved emergency alarm system for a building, said method comprising:

(a) providing energy to components of the emergency alarm system by using a power supply means that is made immune from temporary interruption, whether intentional or accidental, of power supply by using a power-failure detector which automatically triggers shut-off module batteries;

(b) demonstrating any desired alpha-numeric display in any desired color on a visible outdoor board being located adjacent to entrance of the building, with non-emergency conditions in the building being indicated by one color and emergency conditions in the building being indicated by a different color on the visible outdoor board;

(c) triggering a central control unit by:

i. turning on, when desired, a manually-operated control button or switch of a portable control element, or ii. activating a signal-generating detection means by:

A. automatic sensing of movement by a hidden sensing circuit being adapted to sense movement of an individual on a covering placed over an open-circuit detector, B. activation of the hidden sensing circuit by the open-circuit detector when continuity of an electrical circuit of a series of connected sensors is interrupted, and C. activation, by the open-circuit detector, of a power switch and blinker to feed a signal generator which forwards a generated signal to a multi-display selector for triggering any selected alarms;

(d) upon activation of the central control unit, starting an alarm by:

i. triggering solely the audio alarm generator, which upon activation starts an alarm, ii. triggering solely the visual alarm generator, which upon activation causes a change in color of the visible outdoor board, iii. triggering the audio alarm generator by the visual alarm generator after the visual alarm generator is triggered, iv. triggering the visual alarm generator by the audio alarm generator after the audio alarm generator is triggered, or v. triggering the audio alarm generator and the video alarm generator simultaneously;

(e) personally or automatically, through use of information saved in the central control unit, informing and getting assistance from a third party if desired; and (f) stopping an audio alarm or a visual alarm through use of the central control unit by:

i. turning on a reset switch; or ii. turning off, when desired, a manually-operated control button or switch of the portable control element.

5. The method of operation of the new and improved emergency alarm system of claim 4, wherein the emergency alarm system is activated by:

(a) voluntary interruption by the user of the emergency alarm system;

(b) detection of entry of an intruder into the building without knowledge of the user of the emergency alarm system by using a signal detection means;

(c) detection of high levels of unwanted gases including, but not limited to, carbon dioxide and carbon monoxide;

(d) detection of a temperature higher than a set limit;

(e) triggering of a smoke detector;

(f) dialing of emergency numbers;

(g) detection of sudden loud noises activated by gun shots, yelling, breaking of a window glass or explosion;

(h) sending of remote radio signals;

(i) sending of signals by surveillance cameras;

(j) turning on of hidden secret switches by the user of the emergency alarm system; or (k) disconnection of telephone wires or of electrical utility lines.

* * * * *